US010360874B2

(12) United States Patent
Trattler

(10) Patent No.: US 10,360,874 B2
(45) Date of Patent: Jul. 23, 2019

(54) MODULE CIRCUIT, DISPLAY MODULE AND METHOD FOR PROVIDING AN OUTPUT SIGNAL

(71) Applicant: ams AG, Unterpremstätten (AT)

(72) Inventor: Peter Trattler, Graz (AT)

(73) Assignee: ams AG, Unterpremstaetten (AT)

( * ) Notice: Subject to any disclaimer, the term of this patent is extended or adjusted under 35 U.S.C. 154(b) by 476 days.

(21) Appl. No.: 14/361,289

(22) PCT Filed: Nov. 7, 2012

(86) PCT No.: PCT/EP2012/072056
§ 371 (c)(1),
(2) Date: May 28, 2014

(87) PCT Pub. No.: WO2013/079290
PCT Pub. Date: Jun. 6, 2013

(65) Prior Publication Data

US 2014/0313175 A1 Oct. 23, 2014

(30) Foreign Application Priority Data

Nov. 29, 2011 (DE) ..... 10 2011 119 661

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/064* (2013.01); *G09G 2360/144* (2013.01)

(58) Field of Classification Search
CPC ..... G09G 5/10; G09G 3/34–3426
See application file for complete search history.

(56) References Cited

U.S. PATENT DOCUMENTS

2007/0035706 A1 2/2007 Margulis
2008/0006762 A1* 1/2008 Fadell ..... G01J 1/4204 250/201.1
2008/0179497 A1 7/2008 Maniam et al.
(Continued)

FOREIGN PATENT DOCUMENTS

DE 19907950 A1 9/2000
WO 2008/130060 A1 10/2008
WO 2010/032198 A1 3/2010

OTHER PUBLICATIONS

Brown, Chris J. et al., "A Continuous-Grain Silicon-System LCD With Optical Input Function", IEEE Journal of Solid-State Circuits, vol. 42, No. 12, Dec. 2007, pp. 2904-2912.

*Primary Examiner* — William Boddie
*Assistant Examiner* — Jeffrey Parker
(74) *Attorney, Agent, or Firm* — Fish & Richardson P.C.

(57) ABSTRACT

A module circuit (11) comprises a sensor terminal (43) for feeding a sensor signal (SP) and a clock terminal (41) for feeding a pulse width-modulated clock signal (ST) having a first and a second clock phase (A, B). A signal processing circuit (40) of the module circuit (11) is coupled on the input side to the sensor terminal (43) and the clock terminal (41) and is designed to provide an output signal (SAL) dependent on the sensor signal (SP) that can be tapped in the first clock phase (A) and independent of the sensor signal (SP) that can be tapped in the second clock phase (B).

15 Claims, 7 Drawing Sheets

(56) References Cited

U.S. PATENT DOCUMENTS

Figure 1A:
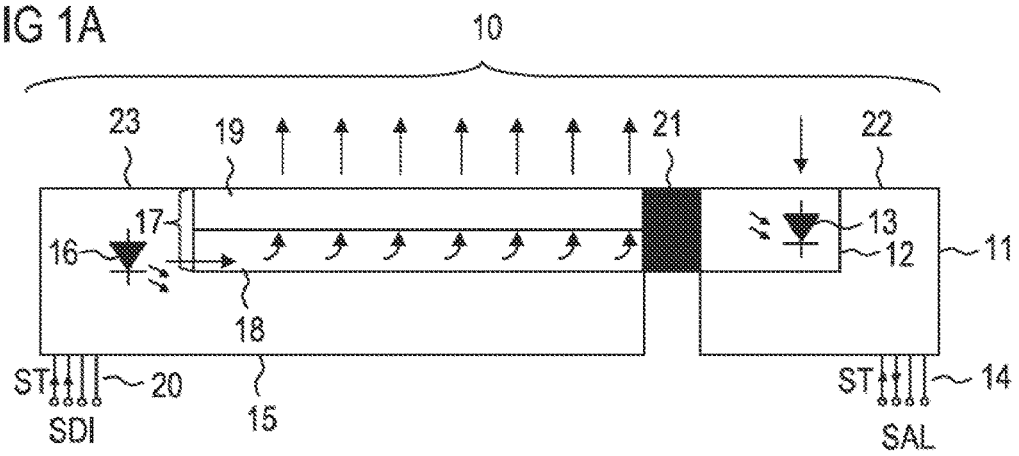

| | | | | |
|---|---|---|---|---|
| 2008/0284716 | A1* | 11/2008 | Edwards | G09G 3/3406 345/102 |
| 2009/0273288 | A1* | 11/2009 | Zhao | G09G 3/342 315/185 R |
| 2010/0078562 | A1 | 4/2010 | Dinh et al. | |
| 2010/0110096 | A1 | 5/2010 | Satoh et al. | |
| 2011/0063268 | A1* | 3/2011 | Knapp | H04L 12/42 345/207 |
| 2011/0084924 | A1* | 4/2011 | Chang | G06F 3/0416 345/173 |

* cited by examiner

MODULE CIRCUIT, DISPLAY MODULE AND METHOD FOR PROVIDING AN OUTPUT SIGNAL

The present patent application relates to a module circuit, a display module and a method for providing an output signal.

A display module frequently comprises a display, an ambient light sensor, a light source and a circuit for evaluating a sensor signal of the ambient light sensor. Such display modules are used for instance in devices for mobile radio communication. The sensor signal from the ambient light sensor can be influenced by the light emitted by the light source.

Document US 2010/0078562 A1 is concerned with the arrangement of sensors such as an ambient light sensor or a proximity sensor in an electronic device.

Document US 2010/0110096 A1 describes a display component for a device in mobile radio communications. In this case, a shield prevents stray light emitted by the back-lighting from falling on a detector.

In one embodiment, a module circuit comprises a sensor terminal, a clock terminal and a signal processing circuit, which is coupled on the input side to the sensor terminal and the clock terminal. The sensor terminal is used for supplying a sensor signal. The clock terminal is provided for supplying a pulse width-modulated clock signal that has a first and a second clock phase. The signal processing circuit is designed to provide an output signal dependent on the sensor signal it can tap in the first clock phase and independent of the sensor signal it can tap in the second clock phase.

The sensor signal is advantageously not continuously evaluated. Only values of the sensor signal from the first clock phase are taken into consideration for determining the output signal. Thus the period of time within a period of the clock signal in which the output signal is influenced by the sensor signal can be adjusted by means of the pulse width-modulated clock signal.

In one embodiment, the module circuit comprises a driver circuit that is coupled on the input side to the clock terminal. A light source can be connected to the driver circuit. The light source can be used for back-lighting. The driver circuit is designed to switch off the coupling-capable light source in the first clock phase of the clock signal, and to switch it on in the second clock phase of the clock signal. The light source is therefore activated precisely in the clock phase in which the sensor signal influences the output signal. Additionally, the light source is activated precisely in the period of time during which the sensor signal does not influence the output signal. Because the light source and the supply line of the sensor signal for processing are activated at different times, an influence on the output signal by light emitted by the light source is out of the question. The module circuit can be used for supplying the light source.

In one embodiment, the signal processing circuit is designed to generate the output signal in each case by integrating the sensor signal in the first clock phase of the clock signal. Interference is advantageously further reduced by integrating the sensor signal.

In one embodiment, the signal processing circuit is designed to constantly adjust the output signal in the second clock phase of each clock signal to the value of the output signal at the end of the first clock phase of the clock signal. Holding the output signal constant in the second clock phase has the advantageous effect that an output signal different from zero is continuously provided, which allows a control of the light source for example.

In one embodiment, the signal processing device is designed to determine the output signal on the basis of a trigger signal for a display. The module circuit is coupled to the display. The trigger signal is designed such that it has the information to be represented by the display. The output signal is advantageously dependent on the trigger signal and the sensor signal.

In a refinement, the signal processing device is designed to determine the output signal on the basis of the number of activated pixels and the total number of pixels of the display as well as the light permeability of the pixels.

In one embodiment, the module circuit comprises an ambient light sensor. The ambient light sensor is coupled to the sensor terminal. The sensor signal can be tapped at the ambient light sensor. By means of the ambient light sensor, the brightness of the light striking the module circuit can be determined with high precision in the first clock phase. Light from the light source can strike the ambient light sensor by reflection, for example. Influence on the output signal by reflected light from the light source is avoided by the alternating activation of the light source and the ambient light sensor.

In one refinement, the module circuit is arranged such that the ambient light sensor obtains the light through the display. An activated pixel and a non-activated pixel have a different permeability with respect to light beams. The light permeability of the activated pixel is lower than the light permeability of the non-activated pixel. The precision with which the output signal is determined can be increased by taking into account the number of activated pixels and their light permeability. In an alternative embodiment, the output signal is determined by the signal processing device on the basis of the number of activated pixels and the number of non-activated pixels in the display.

In one embodiment, the signal processing circuit comprises an analog-digital converter, which is coupled to the sensor terminal. The sensor signal is fed to the analog-digital converter. Digital further processing of the sensor signal is advantageously enabled by means of the analog-digital converter.

In a refinement, the signal processing circuit comprises an evaluation circuit that is coupled via the analog-digital converter to the sensor terminal. The evaluation circuit is implemented as a digital circuit. The evaluation circuit can have a microprocessor or a microcontroller. The evaluation circuit comprises a memory. The memory stores the digitized sensor signal provided by the analog-digital converter.

In a refinement, the analog-digital converter is coupled on the input side to the clock terminal. The analog-digital converter is implemented as an integrating converter. The analog-digital converter is designed to integrate the sensor signal in the first clock phase. An integration time period of the analog-digital converter is situated exclusively within the first clock phase. A specifiable delay time can be provided between the beginning of the first clock phase and the beginning of the integration time period.

In a refinement, the driver circuit is coupled to the signal processing circuit. The output signal is fed to the driver circuit. The driver circuit is designed to adjust, on the basis of the output signal, a brightness of the coupling-capable light source. For this purpose, the driver circuit can be designed to adjust the level of the current fed in the second clock phase to the coupling-capable light source, or to adjust the level of the voltage fed in the second clock phase to the coupling-capable light source on the bass of the output signal. Alternatively, the driver circuit can be designed to adjust the average level of the current fed in the first and second clock phases to the coupling-capable light source, or to adjust the average level of the voltage fed in the first and second clock phases to the coupling-capable light source on the basis of the output signal.

In one embodiment, the module circuit comprises a proximity sensor. The proximity sensor is coupled to the signal processing circuit. The signal processing circuit operates the proximity sensor. The proximity circuit can be activated in the phase in which the light source is switched off, namely the first clock phase. This prevents optical or electrical influence on the proximity sensor by the light source. Because the driver circuit, the light source and the proximity sensor are supplied by the same battery, electrical influences could otherwise appear during simultaneous operation.

In a refinement, the proximity sensor is operated exclusively in the first clock phase. The proximity sensor is not operated in the second clock phase.

In one embodiment, the display module comprises the module circuit. The display module can further comprise the display. In addition, the display module can have the light source. The light source is arranged as back-lighting for the display. The light source can comprise at least one light-emitting diode, abbreviated LED.

In one embodiment, the light source is coupled to the sensor terminal. The sensor signal can be tapped at the light source. The LED outputs the sensor signal. The light source is advantageously not used only for emitting light to the display in the second clock phase, but is also used for detecting the brightness of the surroundings in the first clock phase. Thus an ambient light sensor is unnecessary in this embodiment.

In an alternative embodiment, the module circuit of the display module comprises the ambient light sensor. The display module has a light-impermeable barrier between the ambient light sensor and the display. The display module is free of a light-impermeable barrier between the ambient light sensor and the light source. The display module can be realized cost-effectively by omitting such a barrier. The display module is thus free of a shield of the ambient light sensor from the display and the light source. The accuracy of the determination of the sensor signal and thus the output signal is achieved in that the period of time in which the light source is activated does not overlap the period of time in which the output signal is determined from the sensor signal.

In a refinement, the display module comprises the proximity sensor. The proximity sensor can also be arranged outside the module circuit. It is coupled to the signal processing circuit of the module circuit.

In one embodiment, a method for providing an output signal comprises supplying a sensor signal and supplying a pulse width-modulated signal having a first and a second clock phase. An output signal is provided on the basis of the sensor signal that can be tapped in the first clock phase and independently of the sensor signal that can be tapped in the second clock phase.

The output signal is advantageously determined exclusively from values of the sensor signal that are provided in a temporally defined period of time.

Figure 1B:
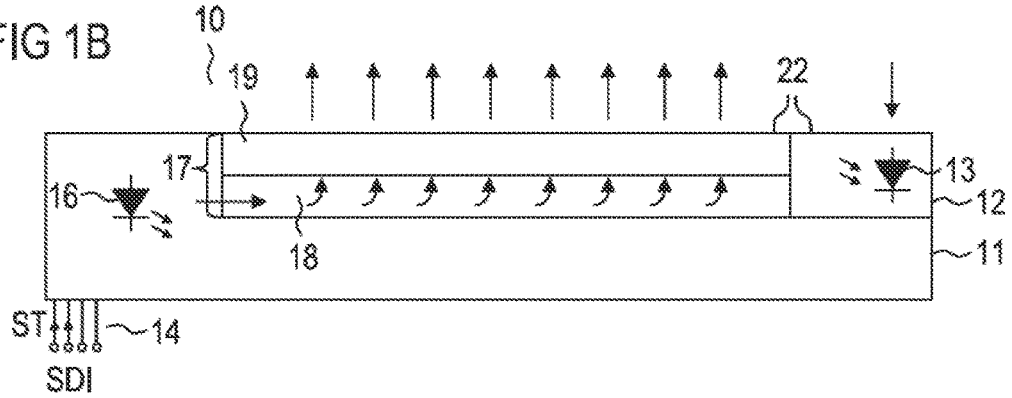
Figure 1C:
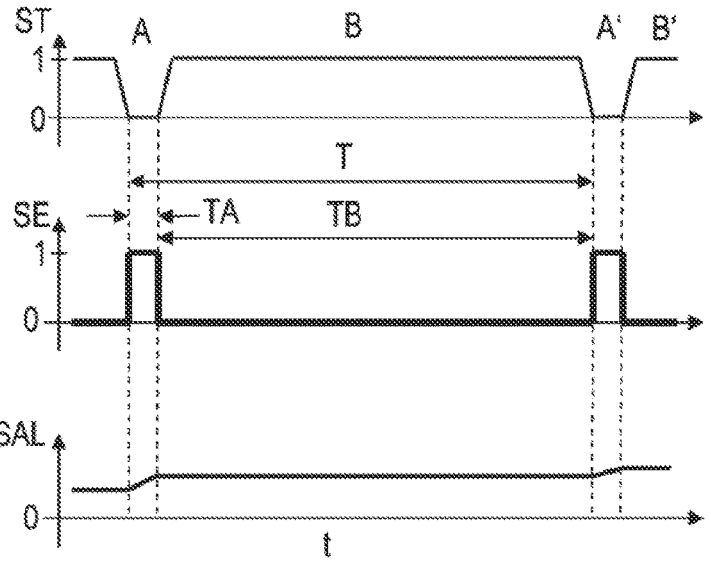
Figure 2A:
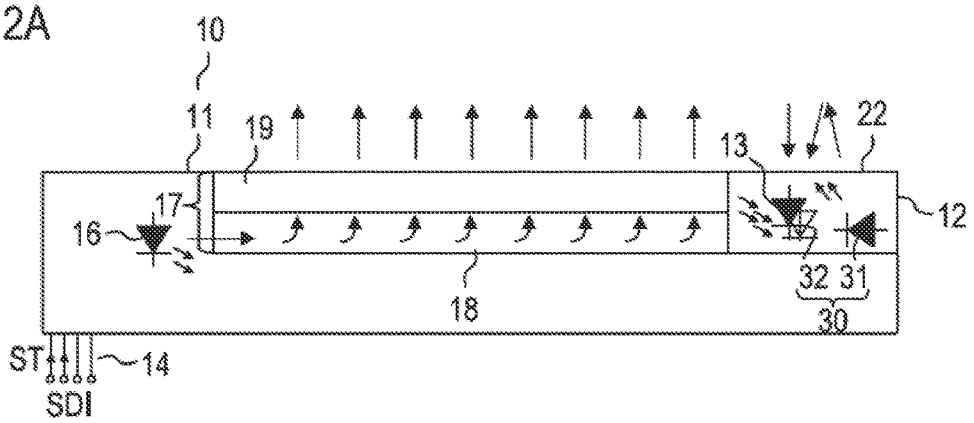
Figure 2B:
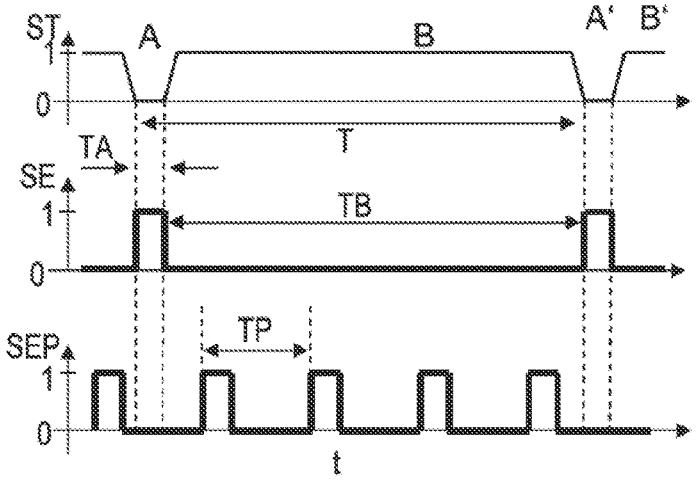
Figure 2C:
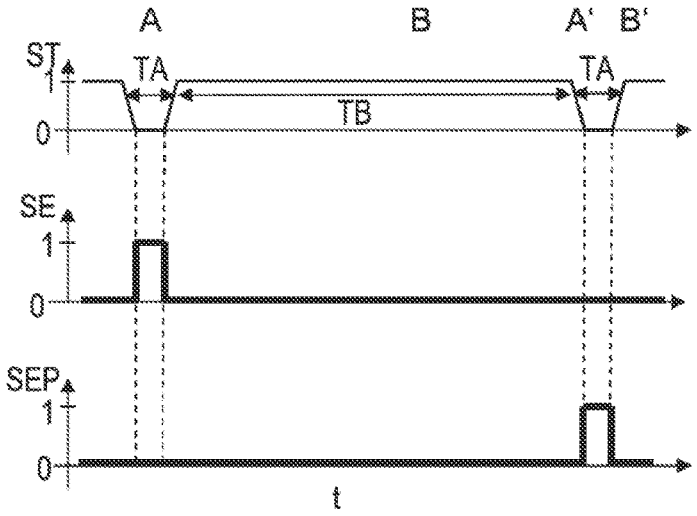
Figure 3A:
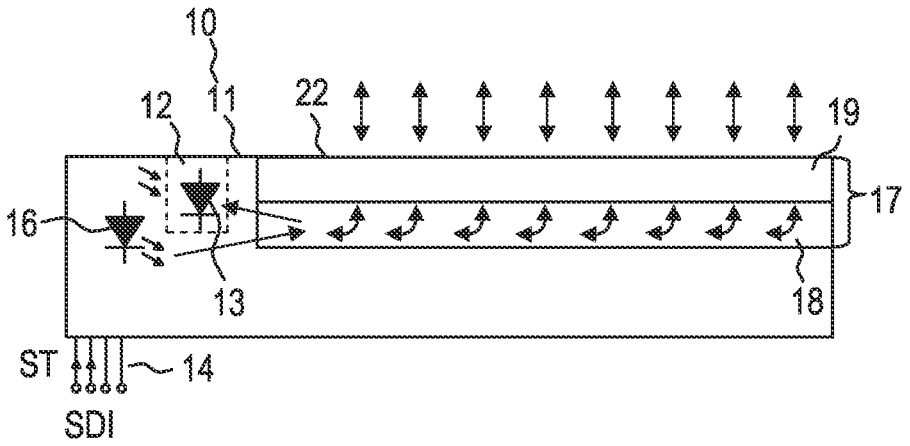
Figure 3B:
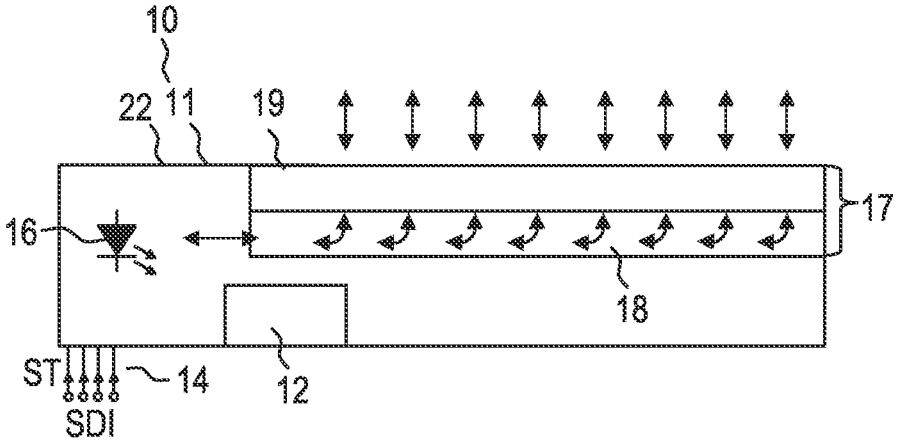
Figure 4A:
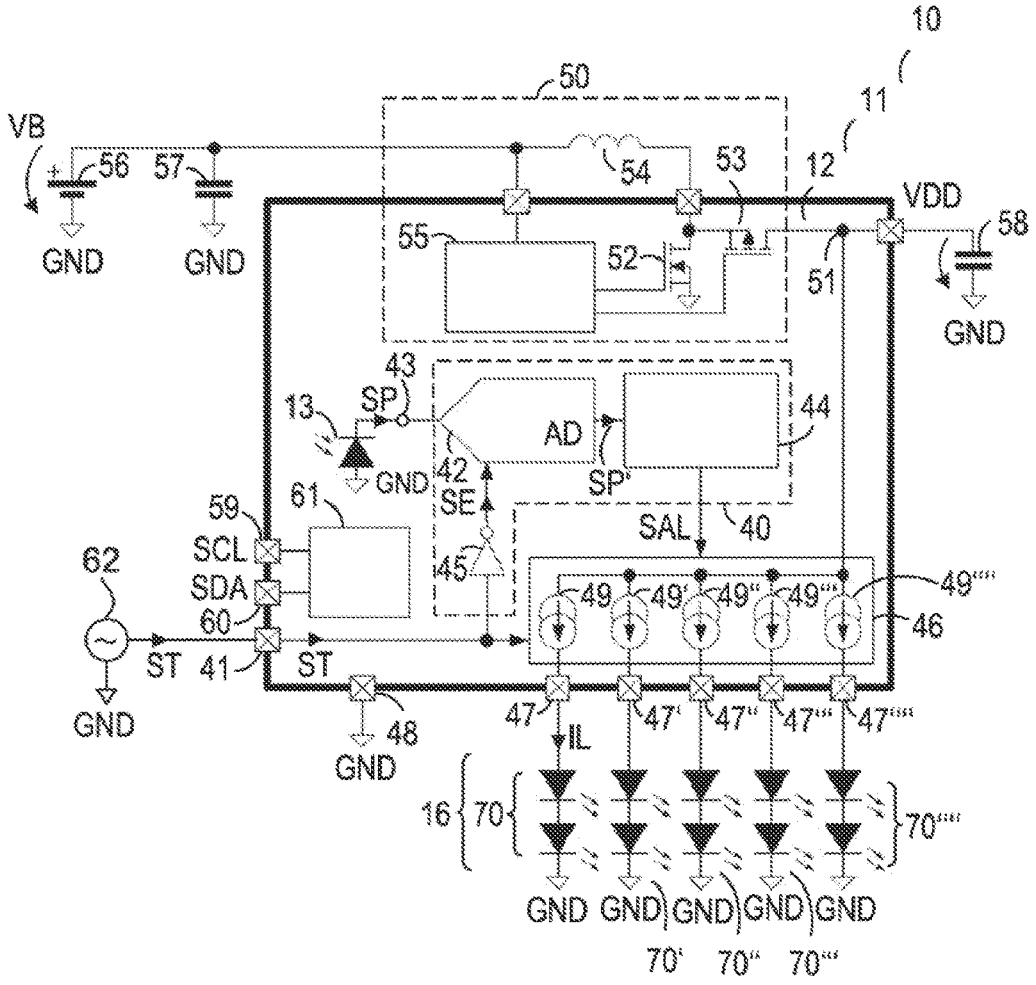
Figure 4B:
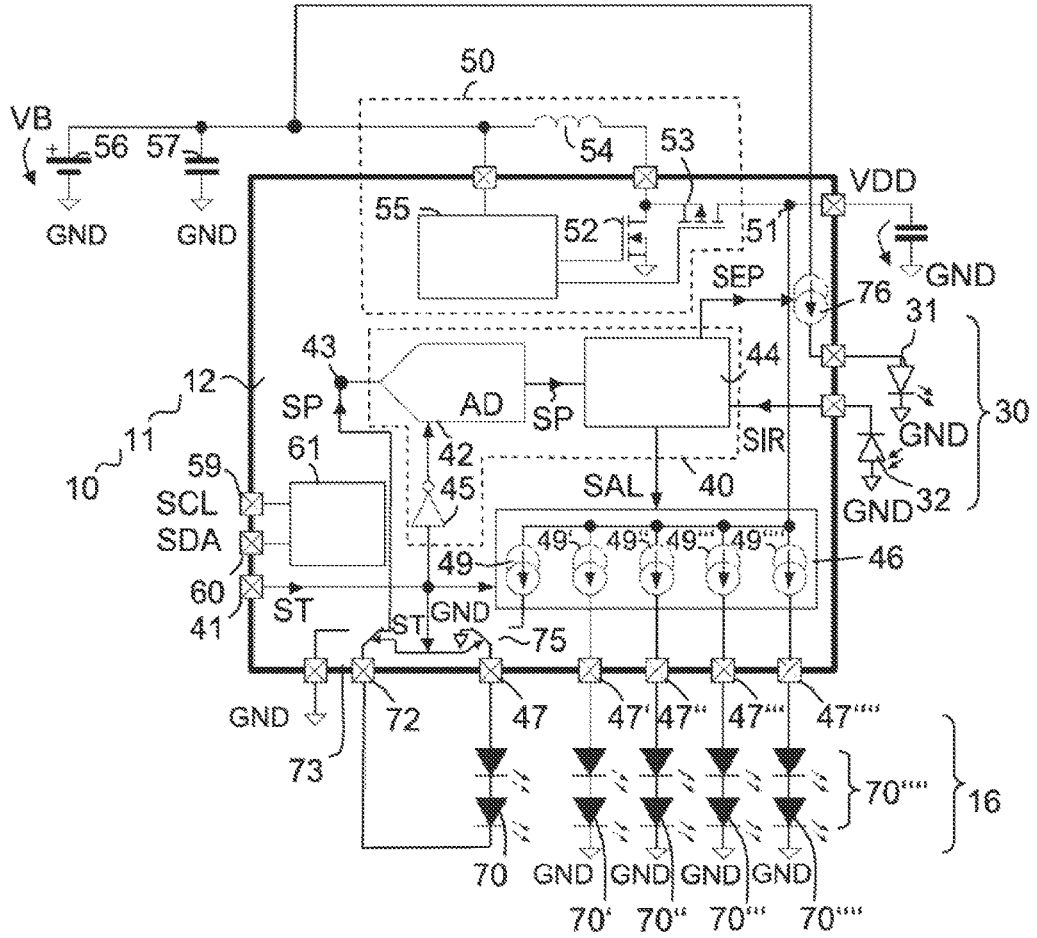
Figure 5A:
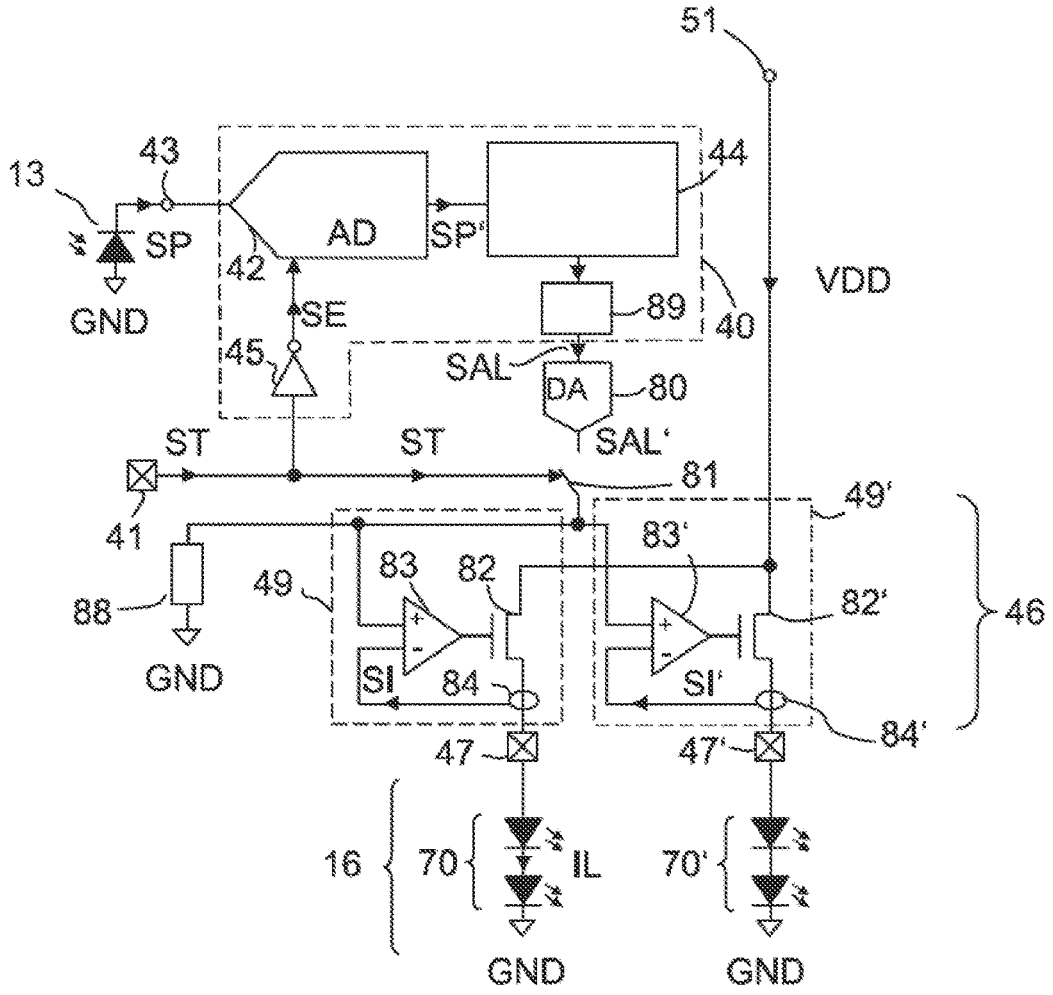
Figure 5B:
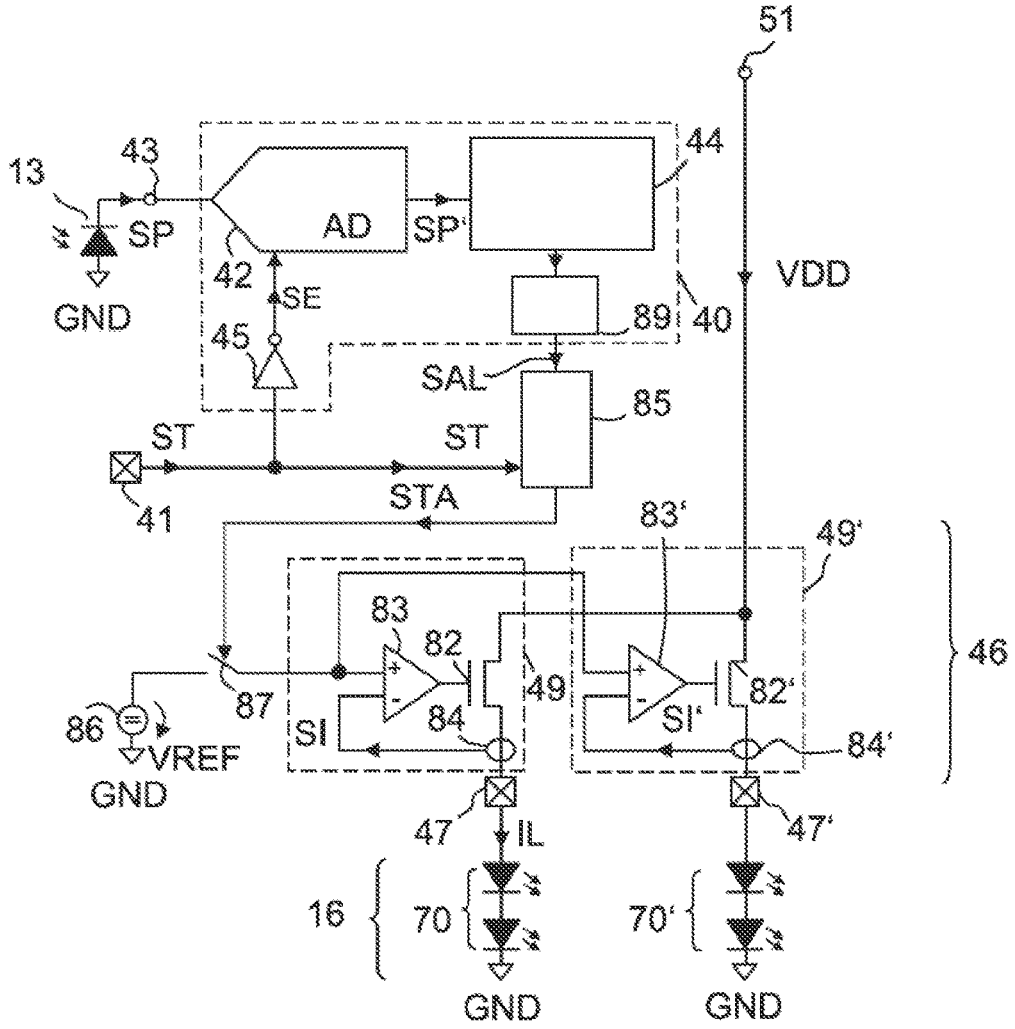

The invention will be described in detail below for several embodiment examples with reference to the figures. Components and circuit elements that are functionally identical or have the identical effect bear identical reference numbers. Insofar as circuit parts or components correspond to one another in function, a description thereof will not be repeated in each of the following figures. In the drawings:

FIGS. 1A-1C show embodiment examples of a display arrangement and of associated signals according to the proposed principle, FIGS. 2A-2C show an additional embodiment example of a display arrangement with associated signals according to the proposed principle, FIGS. 3A and 3B show additional embodiment examples of a display arrangement according to the proposed principle, FIGS. 4A and 4B show additional embodiment examples of a display arrangement according to the proposed principle, and FIGS. 5A and 5B show additional embodiment examples of details of a display arrangement according to the proposed principle.

FIG. 1A shows an embodiment example of a display arrangement according to the proposed principle. The display arrangement 10 comprises a display circuit 11. The display module 11 has a module circuit 12. The module circuit 12 comprises an ambient light sensor 13. The ambient light sensor 13 is constructed as a photoelectric diode. The display module 11 has a terminal 14. The terminal 14 is implemented as a multi-wire terminal. The display arrangement further comprises a further module 15. The further module 15 comprises a light source 16 and a display 17. The light source 16 has at least one light-emitting diode, abbreviated LED. The display 17 comprises a diffuser 18 and a display unit 19. The diffuser 18 can be referred to as a light-distributing unit. The display unit 19 is constructed as a liquid crystal display, abbreviated LCD. The diffuser 18 is arranged between the light source 16 and the display unit 17. The light source 16 is realized as a back-light unit. In addition, the further module 15 comprises a further terminal 20. The further terminal 20 is implemented with multiple wires. The further module 15 has a driver, not shown, for triggering the light source 16.

The display arrangement 10 further comprises a barrier 21 that is arranged between the display module 11 and the further module 15. The barrier 21 is light-impermeable. The barrier 21 is arranged such that light incidence onto the ambient light sensor 13 due to light emitted from the light source 16 or the display 17 is avoided. The display 17 emits light mainly perpendicular to the first main surface 23 of the further module 15. A first main surface 22 of the display module 11 and the first main surface 23 of the further module 15 are arranged in one plane. The light source 16 emits light in such a manner that it exits via the diffuser 17 and the display unit 19 at the first main surface 23. The ambient light sensor 13 is provided for controlling the brightness of the light source 16. The brightness of the light source 16 depends on the brightness of the ambient light, which is detected by the ambient light sensor 13. A lower brightness of the light source 16 is required in dark surroundings. On the other hand, a high brightness of the light source 16 is necessary in bright surroundings.

This advantageously conveys the impression to the user that the display 17 always has the same brightness as the ambient light that surrounds the display 17. The ambient light sensor 13 is arranged such that it receives light through a beam path separated from the display 17. A recess can be provided for such a beam path. In particular, a hole can be drilled in the housing for this beam path. The barrier 21 advantageously prevents the back-light emitted by the light source 16 from influencing the ambient light sensor 13.

FIG. 1B shows an additional embodiment example of a display arrangement according to the proposed principle. Differently from the display arrangement according to FIG.

1A, the barrier 21 is omitted in the display arrangement according to FIG. 1B. The module circuit 12 with the ambient light sensor 13 is thus in direct contact with the display 17. A light-impermeable barrier 21 is not arranged between the display 17 and the module circuit 12. There is also no light-impermeable barrier 21 arranged between the light source 16 and the module circuit 12. The display module comprises the light source 16 and the display 17. The module circuit 12 is arranged in such a manner that the ambient light sensor 13 detects mainly light that strikes the first main surface 22 of the display module 11 vertically. The ambient light sensor 13 receives light through an opening, not shown, through which the display 17 emits light. The display 17 and the module circuit 12 are arranged with respect to one another such that light incident onto the display 17 can also strike the module circuit 12. The display 17 emits light perpendicular to the first main surface 22 of the display module 11. The ambient light sensor 13 can also receive light emitted by the display 17 or the light source 16.

The display arrangement 10 and the display module 11 are advantageously free of the barrier 21. The ambient light sensor 13, the light source 16 and the display 17 can advantageously be combined in the common display 11 module with small dimensions. The beam path for the ambient light to the ambient light sensor 13 is in the direct vicinity of the beam path of the display 17 to the observer. There is no necessity to provide an additional cutout for the ambient light sensor 13 in a covering. A smaller overall size is advantageously achieved by omitting the barrier 21. The further terminal 20 can also advantageously be eliminated. The costs for realization are advantageously lower as compared to the realization of a display arrangement according to FIG. 1A.

FIG. 1C shows examples of signal curves in a display arrangement 10 according to FIGS. 1A and 1B according to the proposed principle. A clock signal ST, an activation signal SE and an output signal SAL are shown there as a function of time t. The clock signal ST and the activation signal SE repeat periodically and have the same period duration T.

The period duration T is constant. A clock cycle of the clock signal ST and of the deactivation signal SE has a first clock phase A and a second clock phase B. The first clock phase A has a first duration TA. On the contrary the second clock phase B has a second duration TB. They obey the relationship: T=TA+TB. The clock signal ST is a pulse width-modulated signal. The light source 16 is triggered by means of the clock signal ST. The light source 16 is thus operated by pulse-width modulation.

The activation signal SE is approximately the inverted signal of the clock signal ST. While the clock signal ST has the value 0 V in the first clock phase A, the activation signal SE has the logical value 1. In the second clock phase B, the clock signal ST has values greater than 0 V, so that the activation signal SE has the logical value 0. The clock signal ST has a lower edge steepness compared to the activation signal SE. The clock signal ST is fed via the terminal 14 to the module circuit 12 shown in FIGS. 1A and 1B. In the display arrangement 10 according to FIG. 1A, the clock signal ST is additionally also supplied to the module 15 via the further terminal 20. The activation signal SE is generated by the module circuit 12 from the clock signal ST. The output signal SAL is provided by the module circuit 12. The output signal SAL is output via the terminal 14. In the first clock phase A, the output signal SAL is dependent on the light incident on the ambient light sensor 13. According to FIG. 1C, for example, a rise in brightness of the surroundings leads to a rise of a sensor signal SP provided by the ambient light sensor 13, and thus the output signal SAL, during the first clock phase A. During the second clock phase B, the output signal SAL is held constant by the module circuit 12. During the second clock phase B, the output signal SAL is thus independent of the ambient light and therefore independent of the sensor signal SP. The period TA of the first clock phase A can be 1% of the period duration T, for example. The ambient light sensor 13 is active during the pauses of the clock signal ST and determines a mean value of the received light.

FIG. 2A shows an additional embodiment example of a display arrangement according to the proposed principle. In addition to that which is shown in FIG. 1B, the display module 11 according to FIG. 2A has a proximity sensor 30. The proximity sensor 30 comprises an infrared light-emitting diode 31 and an infrared sensor 32. The infrared sensor 32 is realized as an infrared-sensitive photodiode.

FIG. 2B shows example signal curves in the display arrangement according to FIG. 2A. A further activation signal SEP is shown in FIG. 2B. The proximity sensor 30 is activated in accordance with the further activation signal SEP. Corresponding to the further activation signal SEP, the infrared light-emitting diode 31 emits infrared radiation and the infrared sensor 32 receives infrared radiation. If an object is in the vicinity of the first main surface 22, then a high proportion of the infrared radiation emitted by the infrared light-emitting diode 31 is detected by the infrared sensor 32. The intensity of the infrared radiation detected by the infrared sensor 32 is a measure of the distance of an object from the first main surface 22. The further activation signal SEP repeats periodically with a further period duration TP. The further clock signal SEP is likewise realized as a pulse-width modulated signal. The further period duration TP can be different from the period duration T. The proximity sensor 30 is activated when the further clock signal SEP has the logical value 1 and is deactivated if the logical value of the further clock signal SEP is 0. The proximity sensor 30 can also be activated by means of the further clock signal SEP in the second clock phase B of the clock signal ST. The light source 16 emits light in a wavelength range that does not overlap the wavelength range in which the infrared sensor 32 is sensitive. Because the light source 16 and the proximity sensor 30 use different wavelength ranges, the proximity sensor 30 is not influenced optically by the light source 16 or the display 17.

FIG. 2C shows examples of signal curves in the display arrangement according to FIG. 2A, which are an alternative to the time curves shown in FIG. 2B. The proximity sensor 30 is operated only in the first clock phase A. It is activated alternately by the ambient light sensor 13. The proximity sensor 30 is evaluated in every second repetition of the first clock phase A. The ambient light sensor 13 is evaluated in the repetitions of the first clock phase A therebetween. The proximity sensor 30 is not operated in the second clock phase B. Thereby an optical influence on an output signal of the proximity sensor 30 by the light source 16 is avoided. Electrical influence via a battery 56 used for supplying the light source 16 and the proximity sensor 30 is also avoided.

Alternatively, the ambient light sensor 13 and the proximity sensor 30 are operated simultaneously in the first clock phase A.

In an alternative embodiment, not shown, the display arrangement 10 does not comprise an ambient light sensor 13. The output signal SAL is generated by the module circuit 12 on the basis of the signal emitted in the first clock phase A by the infrared sensor 32. The signal output by the infrared sensor 32 in the second clock phase B is not taken into account for generating the output signal SAL.

FIG. 3A shows an additional embodiment example of a display arrangement. The display module 11 is realized in such a manner that the ambient light sensor 13 receives light via the display 17. The ambient light sensor 13 thus detects a component of the light from the surroundings that strikes the first main surface 22 in the area of the display unit 19 and is transmitted by means of the diffuser 18. The ambient light sensor 13 is thus arranged such that it detects the ambient light provided by the display 17. The light path of the ambient light to the proximity sensor 13 is thus approximately the reverse of the light path from the light source 16 to the viewer of the display 17. The ambient light sensor 13 is thus arranged close to the light source 16. The ambient light sensor 13 therefore receives the ambient light through the display unit 17 and the diffuser 18. When passing through the display 17, the ambient light is attenuated corresponding to the contents of the display, or information displayed by the display 17. The module circuit 12 provides the output signal SAL on the basis of the contents of the display 17. The module circuit 12 corrects the sensor signal SP according to the contents of the display 17. A pixel can assume different light permeabilities. The light permeability of a pixel can take on arbitrary values inside a range. For example, the output signal SAL can be calculated from the sensor signal SP according to the following equation:

$$SAL = \frac{SP}{1 - k \cdot \frac{NA}{NN}},$$

where NA is the number of activated pixels multiplied by the light permeability thereof, NN is the number of all pixels and k is an attenuation factor. In this equation, $0<k<1$. In the case of an RGB display, the output signal SAL can be calculated according to the following equation:

$$SAL = \frac{SP}{1 - kR \cdot \frac{NR}{NN} - kG \cdot \frac{NG}{NN} - kB \cdot \frac{NB}{NN}},$$

wherein NR is the number of activated red pixels multiplied by the light permeability thereof, NG is the number of activated green pixels multiplied by the light permeability thereof, NB is the number of activated blue pixels multiplied by the light permeability thereof, and kR, kG and kB are the respective attenuation factors for red, green and blue pixels. RGB is the abbreviation for red-green-blue.

In an alternative embodiment, the ambient light sensor 13 is realized as a color sensor. The color sensor can be an RGB sensor. The color sensor provides a red, a green, and a blue sensor signal SPR, SPG, SPB. The output signal SAL can be calculated according to the following equation:

$$SAL = \frac{SPR}{1 - kR \cdot \frac{NR}{NNR}} + \frac{SPG}{1 - kG \cdot \frac{NG}{NNG}} + \frac{SPB}{1 - kB \cdot \frac{NB}{NNB}},$$

NNR is the total number of red pixels, NNG is the total number of green pixels and NNB is the total number of blue pixels. Thus the output signal SAL can be calculated with high accuracy by means of an ambient light sensor 13 formed as an RGB color sensor, as well as the information on the number of activated pixels for the three different colors red, green and blue and the total number of pixels.

FIG. 3B shows an additional embodiment example of a display arrangement according to the proposed principle. According to FIG. 3B, the ambient light sensor 13 is omitted in the display module 11. The display module 11 has the light source 16. The light source 16 is additionally used as an ambient light sensor. The light source 16 comprises at least one light-emitting diode. The light source, or alternatively the light sources, are used for detecting the ambient light. The signal SP can be tapped at the light-emitting diode or light-emitting diodes. If light falls on a light-emitting diode, the light-emitting diode generates a current. The sensor signal SP is thus configured as a current. This current is measured in the first clock phase A and is used as an approximate value for the brightness of the ambient light at the display 17. The light source 16 is thus used alternately as a light-emitting component and as a light-detecting component. Thereby the expense and costs for the realization of the display module 11 are advantageously reduced.

FIG. 4A shows an additional embodiment example of the display arrangement according to the proposed principle. The module circuit 12 shown in FIG. 4A can be used in one of the above-explained display modules 11. The module circuit comprises the ambient light sensor 13 and a signal processing circuit 40, which is connected on the input side via a sensor terminal 43 to the ambient light sensor 13. The signal processing circuit 40 is additionally connected to a clock terminal 41 of the module circuit 12. The signal processing circuit 40 comprises an analog-digital converter 42. An output of the analog-digital converter 42 is coupled via the sensor terminal 43 to the ambient light sensor 13. An evaluation circuit 44 of the signal processing circuit 40 is connected to an output of the analog-digital converter 42. A control input of the analog-digital converter is coupled to the clock terminal 41. An inverter 45 of the signal processing circuit 40 is arranged between the clock terminal 41 and the control input of the analog-digital converter 42.

The module circuit 12 further comprises a driver circuit 46, which is coupled on the input side to the clock terminal 41. The evaluation circuit 44 is additionally connected on the output side to the driver circuit 46. The driver circuit 46 is connected to a driver output 47 of the module circuit 12. The light source 16 is connected to the driver output 47. The light source 16 is realized as a light-emitting diode array. The light source 16 comprises at least one light-emitting diode chain 70. The light-emitting diode chain 70 comprises at least one LED. In the example shown in FIG. 4A, the light-emitting diode chain 70 has two LEDs. The module circuit 12 has a reference potential terminal 48. The light source 16 is arranged between the driver output 47 and the reference potential terminal 48. The driver circuit comprises at least one current regulator 49, which is connected on the output side to the driver output 47. The current regulator 49 can be realized as a current source or a current sink. In the embodiment example according to FIG. 4A, the light source 16 comprises five parallel-connected light-emitting diode chains 70, 70', 70", 70''', 70''''. Each light-emitting diode chain has two light-emitting diodes. Accordingly, the module circuit 12 comprises five driver outputs 47, 47', 47", 47''', 47''''. Consequently the driver circuit 46 comprises five current regulators 49, 49', 49", 49''', 49'''', which are connected via the five driver outputs 47, 47', 47", 47''', 47'''' to the five light-emitting diode chains 70, 70', 70", 70''', 70'''' of the light source 16.

The module circuit 12 further comprises a voltage converter 50. The voltage converter 50 is realized as a DC/DC converter. The voltage converter 50 is implemented as a boost converter. The voltage converter 50 comprises a first and a second transistor 52, 53, as well as a coil 54. A first terminal of the coil 54 is connected to a battery 56. In addition, an input capacitor 57 is connected to the first terminal of the coil 54. A second terminal of the coil 54 is connected via the first transistor 52 to the reference potential terminal 48 and via the second transistor 53 to a voltage converter output 51. The voltage converter 50 further comprises a voltage converter controller 55, which is connected on the output side to the first and second transistors 52, 53. The driver circuit 46 is connected to the voltage converter output 51. For this purpose, the current regulators 49, 49', 49", 49''', 49'''' are coupled to the voltage converter output 51. An output capacitor 58 is connected to the voltage converter output 51. The clock terminal 41 and the output of the evaluation circuit 44 are coupled by a circuit, not shown in FIG. 4A, to the control terminals of the current regulators 49, 49', 49", 49''', 49''''. The module circuit 12 additionally comprises a first and a second interface terminal 59, 60, as well as an interface circuit 61 that is connected to the first and second interface terminals 59, 60. A clock generator 62 of the display module 11 is coupled to the clock terminal 41.

The module circuit 12 comprises a semiconductor body. Only a single semiconductor body comprises the ambient light sensor 13, the signal processing device 40 and the driver circuit 46. The module circuit 12 is integrated on a first main surface of the semiconductor body. The coil 54, the battery 56, the input capacitor 57, the output capacitor 58, the clock generator 62 and the light source 16 are not arranged on the semiconductor body.

The clock signal ST is fed to the clock terminal. The clock signal ST is generated by the clock generator 62. The ambient light sensor 13 is realized as a photodiode. The module circuit 12 is housed in such a manner that light has access to the ambient light sensor 13. The ambient light sensor 13 is arranged between the sensor terminal 43 and the reference potential terminal 48, at which the reference potential GND is present. The anode of the photodiode is connected to the reference potential terminal 48, and the cathode of the photodiode of ambient light sensor 13 is connected to the sensor terminal 43. If light is incident, the ambient light sensor 13 generates the sensor signal SP. The sensor signal SP is a photocurrent provided by the photodiode.

The sensor signal SP is fed to the signal input of the analog-digital converter 42. The inverter 45 generates the activation signal SE from the clock signal ST. The activation signal SE is fed to the control input of the analog-digital converter 42. In accordance with the activation signal SE, the sensor signal SP is converted by the analog-digital converter 42 into a digitized sensor signal SP' in the first clock phase A. The analog-digital converter 42 is implemented as an integrating converter. Thus the analog-digital converter 42 integrates up the sensor signal SP during the duration TA of the first clock phase A. The sensor signal SP' provided at the output of the analog-digital converter 42 at the end of the first clock phase A is the output signal SAL. The output signal SAL depends linearly on the sensor signal SP' provided by the analog-digital converter 42. Alternatively, the output signal SAL can depend according to a transfer function on the sensor signal SP' provided by the analog-digital converter 42. For example, the transfer function is implemented in such a manner that a light range is determined from several predetermined light ranges by means of the sensor signal SP', and the value of the current regulator current IL specified for this light range is adjusted by means of the output signal SAL'. Alternatively, the evaluation circuit 44 can be designed to determine the output signal SAL from the digitized sensor signal SP' by means of a control algorithm. The evaluation circuit 44 stores the output signal SAL. The evaluation circuit 44 delivers the stored output signal SAL at its output. The output signal SAL is constant during the second clock phase B. The output signal SAL preferably continues to have the value of the second clock phase B in the next first clock phase A that follows the second clock phase B, until a new value for the output signal SAL is determined by the analog-digital converter 42 and stored by the evaluation circuit 44. Thus the output signal SAL changes only at the respective end of the clock phase A, insofar as the brightness changes.

The clock signal ST is fed to the driver circuit 46. Corresponding to the clock signal ST, the current regulators 49 are triggered in such a manner that they do not deliver any current regulator current IL to the light source 16 in the first clock phase A and deliver current regulator current IL to the light source 16 in the second clock phase B. The value of the current regulator current IL in the second clock phase B is adjusted according to the output signal SAL. If a high brightness of the ambient light is detected by the ambient light sensor 13, then the current regulator current IL assumes a high value. If the ambient light sensor 13 detects a low value for the brightness of the ambient light, on the other hand, then the current regulator current IL likewise takes on a low value.

An input voltage VB can be tapped at the battery 56. The input voltage VB is converted by the voltage converter 50 into a supply voltage VDD. The supply voltage VDD is fed to the driver circuit 46. The supply voltage VDD drops across a series circuit comprising the current regulator 49 and the light-emitting diode chain 70. The voltage converter controller 55 alternately switches on the first and the second transistor 52, 53. If the first transistor 52 is conductive and the second transistor 53 is blocking, the energy from the battery 56 is stored in the coil 54. If the first transistor 52 is then switched to block and the second transistor 53 to conduct, then the energy stored in the coil 54 is stored in the output capacitor 58 or fed to the driver circuit 46. The interface circuit 61 is implemented as an inter-integrated circuit, abbreviated I2C circuit. A first and a second interface signal SCL, SDA corresponding to the conventions for the Inter-Integrated Circuit Bus is applied to the first and second interface terminals 59, 60. The module circuit 12 receives commands by means of the interface circuit 61 and the interface terminals 59, 60. For example, one of the commands is the command to activate the voltage converter 50.

The display arrangement 10 can be used in a device for mobile communication or in a mobile or stationary system. Examples of such systems are digital still cameras, abbreviated DSC, portable media players, abbreviated PMP, or tablet devices. A stationary system can be implemented as a television set. An ambient light sensor 13 is used in these devices and systems for adjusting the brightness of the light source 16 and thus of the display 17.

In an alternative embodiment, the light source 16 has exactly one light-emitting diode chain 70. Alternatively, the light source 16 has more than one light-emitting diode chain. The number of parallel connected light-emitting diode chains can deviate from the number, i.e. five, shown in FIG. 4A.

In an alternative embodiment, not shown, the signal processing circuit 44 is connected to the proximity sensor 30.

In an alternative embodiment, not shown, the analog-digital converter 42 is not realized in an integrated design. An integrator can be arranged between the sensor terminal 43 and the analog-digital converter 42.

FIG. 4B shows a further embodiment example of a display arrangement according to the proposed principle, which is a refinement of the embodiment shown in FIG. 4A. The module circuit 12 shown in FIG. 4B can be used in the display module 11 shown in FIG. 3B. The ambient light sensor 13 is omitted in the module circuit 12 according to FIG. 4B. The light source 16 is used for determining the brightness of the ambient light. For this purpose, the signal input of the analog-digital converter 42 is coupled to the light source 16. The light-emitting diode chain 70 is arranged between the driver output 47 and a further terminal of the module circuit 12. The further terminal 72 is coupled to the reference potential terminal 48 and the signal input of the analog-digital converter 42.

The module circuit 12 has a changeover switch 73, which is connected on the input side to the further terminal 72. A first output of the changeover switch 73 is connected to the reference potential terminal 48 and a second output of the changeover switch 73 is connected to the signal input of the analog digital converter 42. A control input of the changeover switch 73 is coupled to the clock terminal 41. The module circuit 12 has a further changeover switch 75. One output of the further changeover switch 75 is connected via the terminal 47 to the light-emitting diode chain 70. A first input of the further changeover switch 75 is connected to the reference potential terminal 48. A second input of the further changeover switch 75 is connected to the output of the current regulator 49 of the driver circuit 46. The further changeover switch 75 is coupled at a control input to the clock terminal 41.

The display module 11 comprises the proximity sensor 30. The infrared light-emitting diode 31 and the infrared sensor 32 are coupled to the signal processing circuit 40. The module circuit 12 has an additional current regulator 76, which is connected to the infrared light-emitting diode 31. The additional current regulator 76 is connected to the battery 56 and the evaluation circuit 44. The evaluation circuit 44 is also connected to the infrared sensor 32.

In the first clock phase A, the changeover switch 73 is adjusted such that it connects the light-emitting diode chain 70 via the sensor terminal 43 to the signal input of the analog-digital converter 42. In addition, the changeover switch 73 is triggered in the second clock phase B such that it couples the light-emitting diode chain 70 to the reference potential terminal 48. In the first clock phase A, the further changeover switch 75 is set such that it connects the light-emitting diode chain 70 to the reference potential terminal 48. In the second clock phase B, on the other hand, the further changeover switch 75 is set such that it connects the light-emitting diode chain 70 to the current regulator 49. Thus the signal that can be tapped at the light-emitting diode chain 70 is fed as a sensor signal SP to the analog-digital converter 42 in the first clock phase. In the second clock phase B, on the other hand, the current regulator current IL flows through the light-emitting diode chain 70.

The input voltage VB is fed to the additional current regulator 76. The evaluation circuit 44 controls the additional current regulator 76 by means of the further activation signal SEP. The infrared sensor 32 delivers an infrared sensor signal SIR to the evaluation circuit 44. The evaluation circuit 44 determines the distance of an object from the proximity sensor 30 by means of the infrared sensor signal SIR. If an object is in the immediate vicinity of the proximity sensor 30, the output signal SAL is adjusted such that the brightness of the light source 16 is reduced. If an object is in the immediate vicinity of the proximity sensor 30, the touch screen or the sensor screen is deactivated. The output signal SAL is dependent on the sensor signal SP and on the infrared sensor signal SIR.

The module circuit 12 can advantageously be arranged independently of the display 17. The module circuit 12 can be completely enclosed. The module circuit 12 does not require an access window in order to feed the ambient light of the first main surface 22 of the semiconductor body to the module circuit 12.

In an alternative embodiment, not shown, the light-emitting diode chain 70 has exactly one light-emitting diode 74. Alternatively, the light-emitting diode chain 70 can have more than two light-emitting diodes.

In an alternative embodiment, not shown, the infrared sensor 32 is connected to the sensor terminal 43. The changeover switch 73 and the further changeover switch 75 are omitted. The light-emitting diode chain 70 is connected between the current regulator 49 and the reference potential GND, as shown in FIG. 4A. The infrared sensor 32 delivers the sensor signal SP. The output signal SAL is formed on the basis of the sensor signal SP provided by the infrared sensor 32.

FIG. 5A shows embodiment examples of details of a display arrangement according to the proposed principle. The detail shown in FIG. 5A can be realized in the above-described module circuits. The signal processing circuit 40 comprises a control unit 89, which connects the evaluation circuit 44 to the output of the signal processing circuit 40. The module circuit 12 comprises a digital-analog converter 80, which is connected on the output side to the signal processing circuit 40. The digital-analog converter 80 is connected on the input side to an output of the evaluation circuit 44. A clock switch 81 is arranged between the digital-analog converter 80 and the driver circuit 46. A control input of the clock switch 81 is connected to the clock switch 41.

The current regulator 49 comprises a regulator transistor 82, a current sensor 84 and an amplifier 83. The voltage converter output 51 is connected via the regulator transistor 82 to the driver output 47. The amplifier 83 is coupled on the output side to a control terminal of the regulator transistor 82. A first input of the amplifier 83 is coupled via the clock switch 81 to the output of the digital-analog converter 80. A second input of the amplifier 83 is connected to the output of the current sensor 84. The current regulator 49 is realized as a controlled current regulator. The current regulator 49 has an internal control loop. The control loop comprises the regulator transistor 82, the current sensor 84 and the amplifier 103. Correspondingly, the further current regulator 49' comprises a further regulator transistor 82', a further current sensor 84' and a further amplifier 83'. The further current regulator 49' is realized like the current regulator 49. A first input of the further amplifier 83' is connected to the first input of the amplifier 83. A resistor 88 is arranged between the first input of the amplifier 83 and the reference potential terminal 48.

The digital-analog converter 80 converts the output signal SAL into an analog output signal SAL'. In the first clock phase A of the clock signal ST, the clock switch 81 is open. The resistor 88 defines the voltage at the current regulator 49 if the clock switch 81 is switched off. Thus the value 0 V is present at the first input of the amplifier 83, so that the regulator transistor 82 is blocking. Consequently, no current regulator current IL flows through the light-emitting diode chain 70 during the first clock phase A. On the other hand, the clock signal of the clock switch 81 is conductive in the second clock phase B of the clock signal ST. The current regulator 49 is thus triggered on the basis of the output signal SAL. For this purpose, the analog output signal SAL' is supplied to the first input of the amplifier 83. The current sensor 84 delivers a current signal SI, which represents the value of the current regulator current IL as a voltage. A signal at the output of the amplifier 83 is formed according to the comparison of the analog output signal SAL' and the current signal SI, and is fed to the control terminal of the regulator transistor 82. Consequently, the current controller current IL is adjusted by the current regulator 49 in the second clock phase B corresponding to the value specified by the output signal SAL and on the basis of the voltage-to-current ratio of the current sensor 84. The mode of operation of the further current controller 49' corresponds to the mode of operation of the current controller 49.

If the ambient light sensor 13 detects a low brightness in the surroundings, then the output signal SAL takes on a low value based on a transfer function realized by means of the control unit 89 or a transfer function specified above, and consequently, the current regulator current IL also takes on a low value. The clock switch 81 has the effect that the light source 16 is switched off in the first clock phase A and the light source 16 is switched on in the second clock phase B.

FIG. 5B shows a further embodiment example of a display arrangement according to the proposed principle. The details shown in FIG. 5B can be implemented in the display arrangement according to FIGS. 1-4. The current regulator 49 and the further current regulator 49' according to FIG. 5B are realized as shown in FIG. 5A. The module circuit 12 comprises a duty ratio circuit 85. One input of the duty ratio circuit 85 is connected to the clock terminal 41. A second input of the duty ratio circuit 85 is connected to the output of the signal processing circuit 40. The further input of the duty ratio circuit 85 is coupled to the output of the evaluation circuit 44. The module circuit 12 further comprises a reference voltage source 86 and a reference switch 87. The reference voltage source 86 is connected via the reference switch 87 to the input of the current regulator 49. For this purpose, the reference switch 87 is arranged between the reference voltage source 86 and the first input of the amplifier 83. An output of the duty ratio circuit 85 is connected to a control input of the reference switch 87.

The reference voltage source 86 provides a reference voltage VREF. The reference voltage VREF is fed via the reference switch 87 to the current regulator 49 and thus the first input of the amplifier 83. The clock signal ST and the output signal SAL are fed to the duty ratio circuit 85. On the output side, a light-source clock signal STA can be tapped at the duty ratio circuit 85. The light-source clock signal STA is provided on the basis of the clock signal ST and the output signal SAL. The light-source clock signal STA comprises a first and a second clock phase AL, BL. The duration of the first clock phase AL of the light-source clock signal STA is at least the duration TA of the first clock phase A of the clock signal ST. The time period of the first clock phase A of the clock signal ST lies completely within the time period of the first clock phase AL of the light-source clock signal STA.

If the ambient light sensor 13 detects a high value for the brightness of the surroundings, then the duration of the first clock phase AL of the light-source clock signal STA is approximately equal to the duration TA of the first clock phase A of the clock signal ST. If the ambient light sensor detects a low value for the brightness of the surroundings, on the other hand, then the duration of the first clock phase AL of the light-source clock signal STA is significantly longer than the duration TA of the first clock phase A of the clock signal ST. The duty ratio circuit 85 is used as a circuit for adjusting the duty ratio. The duty ratio with which the light source 16 is switched on and off can be adjusted with the duty ratio circuit 85 dependent on the output signal SAL and thus dependent on the brightness of the ambient light. The output signal SAL is present as a digital signal. The duty ratio circuit 85 adjusts the first duration of the first clock phase AL of the light-source clock signal STA stepwise and thus adjusts the duty ratio of the light-source clock signal STA stepwise.

In an alternative embodiment, not shown, the display arrangement shown in FIGS. 5A and 5B comprises further light-emitting diode chains and further current regulators.

The invention claimed is:

1. A module circuit, comprising:

a sensor terminal operable to feed a sensor signal;

a clock terminal operable to feed a pulse width-modulated clock signal having a first and a second clock phase;

a signal processing circuit comprising an analog-digital converter and an evaluation circuit, wherein the analog-digital converter is coupled on an input side to the sensor terminal and the clock terminal, wherein the evaluation circuit is connected to an output of the analog-digital converter, wherein the signal processing circuit is operable to generate an output signal based on the sensor signal and the clock signal, wherein generating the output signal comprises:

tapping the sensor signal during the first clock phase of the clock signal, and integrating the sensor signal tapped during the first clock phase of the clock signal, wherein the output signal is independent of the sensor signal during the second clock phase of the clock signal;

an ambient light sensor that is coupled to the sensor terminal, wherein the ambient light sensor is operable to generate the sensor signal and provide the sensor signal to the sensor terminal;

a proximity sensor coupled to the signal processing circuit;

a driver circuit that comprises a current regulator and is coupled on an input side to the clock terminal, wherein the signal processing circuit is connected on an output side to the driver circuit;

a light source that comprises at least one light-emitting diode and is connected to the current regulator; and a voltage converter operable to provide a supply voltage that drops across a series circuit comprising the current regulator and the at least one light-emitting diode, wherein the driver circuit is operable to:

receive the clock signal through the clock terminal, and provide, using the current regulator, current to the light source during the second clock phase of the clock signal and not during the first clock phase of the clock signal.

2. The module circuit according to claim 1, wherein the signal processing circuit is operable to hold the output signal during the second clock phase of the clock signal constant at a value of the output signal at an end of the first clock phase of the clock signal.

3. The module circuit according to claim 1 or 2, wherein the signal processing circuit is operable to determine the output signal based on a trigger signal for a display.

4. The module circuit according to claim 1, wherein the signal processing circuit is operable to determine the output signal based on a number of activated pixels and a total number of pixels of a display.

5. The module circuit according to Claim 1, wherein the analog-digital converter is operable to integrate the sensor signal in an integration time period that is exclusively inside the first clock phase.

6. The module circuit according to claim 1, wherein the driver circuit is operable to switch off the light source during the first clock phase of the clock signal and to switch the light source on during the second clock phase of the clock signal.

7. The module circuit according to claim 6, wherein the driver circuit is operable to adjust a brightness of the light source based on the output signal.

8. The module circuit according to claim 1, wherein the signal processing circuit is operable to operate the proximity sensor during the first clock phase.

9. A display module, comprising:

a module circuit;

a display; and a light source operable to provide back-lighting for the display, wherein the module circuit comprises:

a sensor terminal for feeding a sensor signal;

a clock terminal for feeding a pulse width-modulated clock signal having a first and a second clock phase;

a signal processing circuit coupled on an input side to the sensor terminal and the clock terminal, wherein the signal processing circuit is operable to receive the sensor signal from the sensor terminal, receive the clock signal from the clock terminal, and generate an output signal based on the sensor signal and the clock signal, wherein generating the output signal comprises:

tapping the sensor signal during the first clock phase of the clock signal, and integrating the sensor signal tapped during the first clock phase of the clock signal, wherein the output signal is independent of the sensor signal during the second clock phase of the clock signal;

an ambient light sensor coupled to the sensor terminal, wherein the ambient light sensor is operable to generate the sensor signal and provide the sensor signal to the sensor terminal; and a proximity sensor coupled to the signal processing circuit, wherein the ambient light sensor is operable to obtain light through the display, and wherein the signal processing circuit is operable to provide the output signal based on contents of the display by correcting the sensor signal according to the contents of the display.

10. The display module according to claim 9, wherein the display module is free of a light-impermeable barrier between the ambient light sensor and the display.

11. A method for providing an output signal, comprising:

receiving, at a signal processing circuit:

a sensor signal generated by an ambient light sensor from a sensor terminal, and a pulse width-modulated clock signal from a clock terminal, wherein the clock signal has a first and a second clock phase;

generating, by the signal processing circuit, an output signal based on the sensor signal and the clock signal, wherein generating the output signal comprises:

tapping the sensor signal during the first clock phase of the clock signal, and integrating, using an evaluation circuit and an analog-digital converter, the tapped sensor signal in an integration time period that is exclusively inside the first clock phase, wherein the analog-digital converter is coupled on the input side to the clock terminal and to the sensor terminal, and connects the sensor terminal to the evaluation circuit, and wherein the output signal is independent of the sensor signal during the second clock phase of the clock signal, operating a proximity sensor by the signal processing circuit, wherein the proximity sensor is coupled to the signal processing circuit, feeding the clock signal to a driver circuit comprising a current regulator and coupled on an input side to the clock terminal, the signal processing circuit being connected on an output side to the driver circuit;

providing, by a voltage converter, a supply voltage that drops across a series circuit comprising the current regulator and at least one light-emitting diode of a light source connected to the current regulator; and providing, by the current regulator of the driver circuit, current to the light source during the second clock phase of the clock signal and not during the first clock phase of the clock signal.

12. A module circuit, comprising:

a sensor terminal operable to feed a sensor signal;

a clock terminal operable to feed a pulse width-modulated clock signal having a first and a second clock phase;

a signal processing circuit comprising an evaluation circuit and an analog-digital converter, wherein the analog-digital converter is coupled on an input side to the clock terminal and to the sensor terminal and connects the sensor terminal to the evaluation circuit, and wherein the signal processing circuit is operable to generate an output signal based on the sensor signal and the clock signal, wherein generating the output signal comprises:

tapping the sensor signal during the first clock phase of the clock signal, and integrating the tapped sensor signal in an integration time period that is exclusively inside the first clock phase, wherein the output signal is independent of the sensor signal during the second clock phase of the clock signal;

an ambient light sensor that is coupled to the sensor terminal, wherein the ambient light sensor is operable to generate the sensor signal and provide the sensor signal to the sensor terminal;

a proximity sensor coupled to the signal processing circuit;

a driver circuit that comprises a current regulator and is coupled on an input side to the clock terminal, wherein the signal processing circuit is connected on an output side to the driver circuit;

a light source that comprises at least one light-emitting diode and is connected to the current regulator; and a voltage converter operable to provide a supply voltage that drops across a series circuit comprising the current regulator and the at least one light-emitting diode, wherein the driver circuit is operable to:

receive the clock signal through the clock terminal, and provide, using the current regulator, current to the light source during the second clock phase of the clock signal and not during the first clock phase of the clock signal.

13. A module circuit, comprising:

an ambient light sensor operable to generate a sensor signal;

a sensor terminal that is coupled to the ambient light sensor and operable to feed the sensor signal;

a clock terminal operable to feed a pulse width-modulated clock signal having a first and a second clock phase;

a signal processing circuit coupled on an input side to the sensor terminal and the clock terminal, wherein the signal processing circuit is operable to receive the sensor signal from the sensor terminal, receive the clock signal from the clock terminal, and generate an output signal based on the sensor signal and the clock signal, wherein generating the output signal comprises:

tapping the sensor signal during the first clock phase of the clock signal, and integrating the sensor signal tapped during the first clock phase of the clock signal, wherein the output signal is independent of the sensor signal during the second clock phase of the clock signal;

wherein the signal processing circuit comprises an evaluation circuit and an analog-digital converter which connects the sensor terminal to the evaluation circuit;

a single semiconductor body comprising the ambient light sensor and the signal processing circuit;

a driver circuit that comprises a current regulator and is coupled on an input side to the clock terminal, wherein the signal processing circuit is connected on an output side to the driver circuit;

a light source that comprises at least one light-emitting diode and is connected to the current regulator; and a voltage converter providing a supply voltage that drops across a series circuit comprising the current regulator and the at least one light-emitting diode, wherein the current regulator comprises a regulator transistor, a current sensor and an amplifier, wherein a voltage converter output of the voltage converter is connected via the regulator transistor to the light source, wherein the amplifier is coupled on an output side to a control terminal of the regulator transistor, wherein an input of the amplifier is connected to an output of the current sensor, wherein the current sensor is operable to deliver a signal representing a value of a current regulator current delivered by the current regulator to the light source.

14. The module circuit according to claim 1, the proximity sensor comprising an infrared light-emitting diode and an infrared sensor.

15. The module circuit according to claim 1, wherein the ambient light sensor is a color sensor.

* * * * *